United States Patent [19]

Yamaguchi et al.

[11] Patent Number: 4,857,411

[45] Date of Patent: Aug. 15, 1989

[54] COMPOSITE BODY AND METHOD OF MANUFACTURING THE SAME

[75] Inventors: Morie Yamaguchi; Chiezo Horita; Shigeo Suzuki; Yasuo Sakata, all of Yokohama, Japan

[73] Assignee: Kabushiki Kaisha Toshiba, Kawasaki, Japan

[21] Appl. No.: 125,783

[22] Filed: Nov. 27, 1987

Related U.S. Application Data

[63] Continuation of Ser. No. 832,770, Feb. 25, 1986, abandoned.

[30] Foreign Application Priority Data

Feb. 26, 1985 [JP] Japan ..... 60-36975

[51] Int. Cl.[4] ..... B22F 3/00

[52] U.S. Cl. ..... 428/546; 419/8; 419/10; 228/122; 228/165

[58] Field of Search ..... 419/8, 10, 38, 66; 228/122, 165; 428/546

[56] References Cited

U.S. PATENT DOCUMENTS

| | | | |
|---|---|---|---|
| 3,839,779 | 10/1974 | Walker | 228/122 |
| 4,137,106 | 1/1979 | Doi et al. | 419/8 |
| 4,350,528 | 9/1982 | Engle | 419/8 |
| 4,358,319 | 11/1982 | Yoshida et al. | 419/8 X |
| 4,412,643 | 11/1983 | Sato et al. | 419/8 X |
| 4,583,502 | 4/1986 | Takahashi et al. | 419/8 X |
| 4,598,025 | 7/1986 | Mizuhara | 228/122 X |
| 4,698,271 | 10/1987 | Moorhead | 228/122 X |

FOREIGN PATENT DOCUMENTS

| | | | |
|---|---|---|---|
| 0052584 | 5/1982 | European Pat. Off. . | |
| 0072424 | 8/1983 | European Pat. Off. . | |
| 0090658 | 10/1983 | European Pat. Off. . | |
| 895819 | 2/1945 | France . | |
| 59-205406 | 11/1984 | Japan . | |
| 1588920 | 4/1981 | United Kingdom | 419/8 |
| 2092050 | 8/1982 | United Kingdom . | |
| 2099044 | 12/1982 | United Kingdom . | |
| 2117799 | 10/1983 | United Kingdom | 419/8 |

OTHER PUBLICATIONS

Rice, R. W., "Joining of Ceramics"; Army Mater. Technological Conference (U.S.A.), 4th, 69–111 (1975).

*Primary Examiner*—Stephen J. Lechert, Jr.
*Assistant Examiner*—Susan Wolffe
*Attorney, Agent, or Firm*—Cushman, Darby & Cushman

[57] ABSTRACT

The invention provides a method of manufacturing a composite body. A bonding portion is formed in a sintered ceramic body. A metal body obtained from a powder containing a metal powder as a main component is combined with the ceramic body. The assembly is sintered and the ceramic body and the metal body are physically bonded at the bonding portion.

46 Claims, 4 Drawing Sheets

COMPOSITE BODY AND METHOD OF MANUFACTURING THE SAME

This is a continuation of application Ser. No. 832,770, filed Feb. 25, 1986, which was abandoned upon the filing hereof.

BACKGROUND OF THE INVENTION

1. Field of the Invention

The present invention relates to a composite body obtained by combining and bonding a sintered metal body and a sintered ceramic body and a method of manufacturing the same.

2. Description of the Prior Art

The use of composite bodies obtained by bonding sintered ceramic bodies with metal bodies as mechanical parts providing high wear-resistance has been the subject of recent study. In the manufacture of such composite bodies, the ceramic and metal bodies must be firmly bonded. Conventional methods of bonding ceramic and metal bodies include thermal insertion, diffusion bonding, and soldering. Since the bonding between the ceramic and metal bodies is weak in these conventional methods, the finished composite bodies have low reliability. In addition, these processes are complex and expensive in terms of production.

Ishida et al. describe a bonding method in Japanese Patent Disclosure No. 59-205406. In this method, a metal ring-shaped body is obtained after pre-forming a metal powder. A sintered ceramic body is fitted in the metal body and the assembly is sintered. In the cooling step after sintering, the sintered metal body contracts and compresses the ceramic body. This method is an example of manufacturing a composite body by thermal insertion and therefore features the problems discussed above.

SUMMARY OF THE INVENTION

It is an object of the present invention to provide a composite body with improved reliability wherein sintered ceramic and metal bodies are firmly bonded, and to provide a method of manufacturing such a composite body.

It is another object of the present invention to provide a method of manufacturing a composite body which has high productivity and a composite body manufactured by this method.

In order to achieve the above objects of the present invention, a bonding portion is formed in a ceramic body. A sintered metal body locks with the bonding portion of the ceramic body provided, if necessary, with an infiltrator, and thus, physically bonds the ceramic and metal bodies together.

DESCRIPTION OF THE PREFERRED EMBODIMENT

Composite Body

Figure 1:
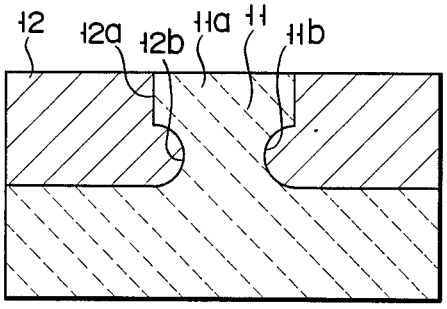
FIG. 1 is a sectional view showing an example of a composite body according to the present invention.

In a composite body according to the present invention, a bonding portion is formed in a sintered ceramic body. A sintered metal body is fitted to the bonding portion or an infiltrator is filled in a space which the bonds portion and the sintered metal body, which bonds the ceramic and metal bodies.

The shapes and sizes of the composite body and the ceramic and metal bodies constituting it, and the method of bonding the ceramic and metal bodies can be changed freely. However, the bonding portion must be able to withstand forces applied to the composite body. Therefore, the bonding portion can be an annular groove or have a step-like profile in a cross-section. Different combinations of ceramic and metal bodies include:

(a) A bonding portion formed in the outer circumferential surface of a ceramic body with a metal body fitted around the outer circumferential surface of the ceramic body with the bonding portion. In this case, the thermal expansion coefficient of the ceramic body is set to be larger than that of the metal body. Combinations of materials satisfying this requirement are $Al_2O_3$, $Si_3N_4$, SiC, $ZrO_2$, and the like for the ceramic body, and invar (36 wt% Ni-Fe alloy) and the like for the metal body.

(b) A bonding portion formed in the inner circumferential surface of a ceramic body, and a metal body is fitted in the inner surface having the bonding portion. In this case, the thermal expansion coefficient of the metal body is selected to be larger than that of the ceramic body. Combinations of materials satisfying this requirement are $Al_2O_3$, $Si_3N_4$, SiC, $ZrO_2$, or the like for the ceramic body, and Fe-based, stainless steel, or Cu-based alloy for the metal body.

Composite bodies consisting of ceramic and metal bodies having different thermal expansion coefficients are effectively manufactured by sintering the bodies in a heated atmosphere. When such a difference in thermal expansion coefficient is present, the ceramic and metal bodies are bonded more firmly.

(c) A bonding portion is formed in the outer circumferential surface of a ceramic body. A metal body is fitted to the outer circumferential surface of the ceramic body. A matrix body consisting of ceramic or metal is fitted around the outer circumferential surface of the metal body. In this case, the thermal expansion coefficients of the materials of the respective bodies are selected such that (ceramic body)<(matrix body)<(metal body). In this combination, a bonding portion can also be formed in the matrix body.

(d) A bonding portion is formed in the inner circumferential surface of a ceramic body. A metal body is fitted in the inner circumferential surface of the ceramic body. A matrix body consisting of a ceramic or metal is fitted around the outer circumferential surface of the ceramic body. In this case, the thermal expansion coefficients of the materials of the respective bodies are selected such that (metal body)<(matrix body)<(ceramic body).

Composite bodies of combinations (c) and (d) are also suitable for manufacture in a heated atmosphere. The reason for this can be surmised as follows. In the case of combination (c), since the matrix body regulates thermal expansion of the metal body, a thermal expansion reaction is generated in the metal body. This reaction force serves to securely bond the ceramic and metal bodies, thereby providing an integral composite body.

In the case of combination (d), since the matrix body regulates thermal expansion of the ceramic body, a thermal expansion reaction is generated in the ceramic body. This reaction force serves to firmly bond the metal and ceramic bodies, again providing an integral composite body.

In order to obtain a metal body with a desired thermal expansion coefficient, the materials can be selected as described above or a ceramic powder such as glass can be mixed with a metal powder.

Method of Manufacturing Composite Body

A composite body of the present invention is manufactured in the following manner:

(a) A sintered ceramic body having a bonding portion is prepared. The shape, size, and material of the ceramic body, and the shape of the bonding portion are selected as described above;

(b) A metal body of a powder consisting mainly of a metal powder is combined with the ceramic body. The metal body can be selected from a metal body having the powder arranged around a ceramic body (M1), a metal body obtained by compressing the powder into a predetermined shape (M2), a metal body obtained by compressing the powder and presintering the compressed powder into a predetermined shape (M3), and a metal body obtained by compressing the powder and sintering the compressed powder into a predetermined shape (M4). When metal body M1 is used, it need not be formed before it is combined with the ceramic body. Therefore, the total number of steps required is reduced. When metal body M2 or M3 is used, since the metal body is very soft, it can be formed easily in a later step. Metal body M4 is used when the selected material has a high tendency to deform;

(c) The metal body combined with the ceramic body is pressed so that part of it is fitted inside the bonding portion of the ceramic body. Each of metal bodies M1 to M4 has a number of pores and can easily deform even if the metal itself cannot be easily deformed. Therefore, the fitting step can be easily performed; and (d) The pressed metal body is sintered with the ceramic body to provide a composite body in which the ceramic and metal bodies are securely locked and bonded with each other.

In sintering step (d) or in a later step, if the metal body is infiltrated with an infiltrator such as copper, the strength of the metal body is increased. In addition, the infiltrator bonds with the ceramic body, thereby improving the bonding strength between the two sintered bodies.

As another method of manufacturing a composite body according to the present invention, in step (b) described above, one of metal bodies M2 to M4 (excluding metal body M1) is combined with a ceramic body. A space is formed enclosed by the bonding portion of the ceramic body and the metal body, step (c) is omitted, and step (d) follows directly. At the same time, an infiltrator such as copper is infiltrated into the bonding portion, thereby manufacturing a composite body. In the obtained composite body, the ceramic and metal bodies are securely bonded with each other and with the infiltrator infiltrated into the bonding portion.

According to still another method of manufacturing a composite body according to the present invention, if no space is formed between the bonding portion of a ceramic body and a metal body (one of M2 to M4), after the metal body is fitted with the ceramic body, sintering step (d) is performed without performing step (c). During or after sintering step (d), the above-mentioned infiltration step can be performed.

Some examples of the shape of composite bodies and manufacturing methods thereof according to the present invention will be described below with reference to the accompanying drawings.

Composite Body in FIG. 1

Ceramic body 11 has rod-like portion 11*a* at the center of a plate. Annular groove 11*b* is formed in a part of the outer circumferential surface of rod-like portion 11*a*, and serves as a bonding portion. Metal body 12 has hole 12*a* for fitting over portion 11*a* of ceramic body 11. Projection 12*b* locks with annular groove 11*b* after the composite body is compressed.

Figure 2:
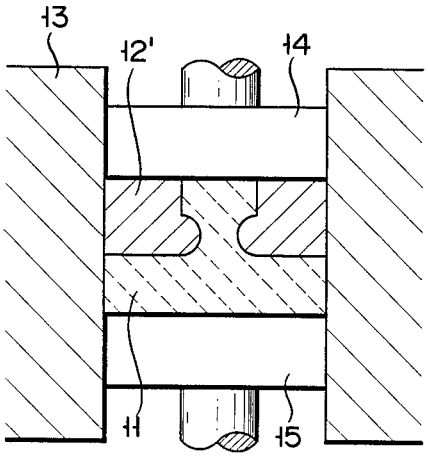
FIGS. 2 and 3 are sectional views showing different embodiments of a method of manufacturing a composite body according to the present invention.

Method of Manufacturing Composite Body—FIG. 2

In order to manufacture this composite body, ceramic body 11 is placed inside die 13. A metal powder filled on ceramic body 11 is pressed by upper and lower punches 14 and 15 to produce green compact metal body 12'. With this method, the metal powder flows and enters groove 11*b* of ceramic body 11. Formed metal body 12' is sintered to provide the composite body shown in FIG. 2.

Figure 3:
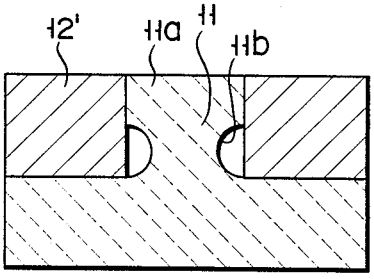

Method of Manufacturing Composite Body—FIG. 3

A metal powder is pressed into green compact metal body 12' with pores. After presintering, metal body 12' is combined with ceramic body 11. Presintered metal body 12' is pressed to partially crease it, such that the creased portion extends into groove 11*b* of ceramic body 11. Metal and ceramic bodies 12' and 11 are sintered to obtain the composite body shown in FIG. 3. In the sintering step or in a later step, the infiltration step can also be performed.

Figure 4:
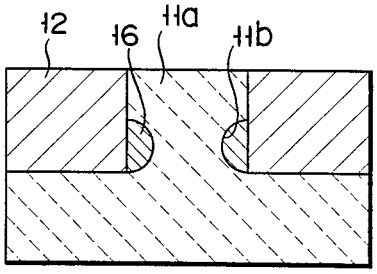
FIGS. 4 to 10 are sectional views showing different embodiments of composite bodies according to the present invention.

Composite Body in FIG. 4 and Method of Manufacturing the Same

Presintered metal body 12' is combined with ceramic body 11. When bodies 12' and 11 are combined, a space is formed between groove 11*b* of body 11 and body 12'. The assembly is sintered without pressing metal body 12', and at the same time or in a later step, an infiltrator such as copper is infiltrated into the bonding portion. In the obtained composite body, the two bodies are bonded at the bonding portion with infiltrator 16.

Figure 5:
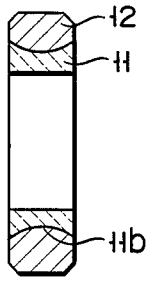
Figure 6:
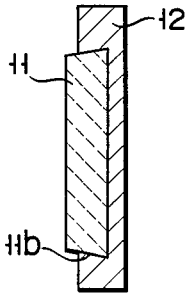
Figure 7:
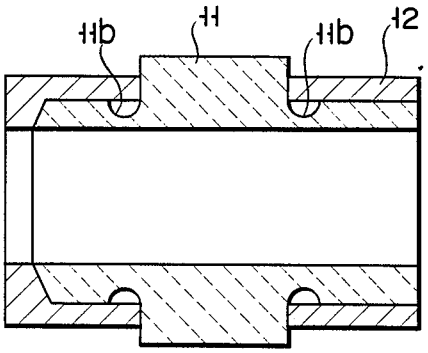

Composite Bodies in FIGS. 5 to 7

The composite bodies shown in these figures have different shapes or combinations of ceramic and metal bodies and bonding portions. These shapes and combinations are selected in accordance with the possible forces expected to be applied uses of the composite bodies and possible applications thereof.

Figure 8:
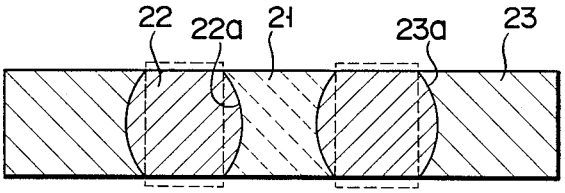

Composite Body in FIG. 8 and Method of Manufacturing the Same

Ceramic body 21 is inserted in a central hole of metal matrix body 23 with a predetermined gap left therebetween. Annular presintered metal body 22, indicated by the dotted line, is fitted in the gap. Metal body 22 is pressed so that it locks with both bonding portion 23*a* of the matrix body and with bonding portion 21*a* of ceramic body 21. The assembly is sintered to obtain the composite body.

Figure 9:
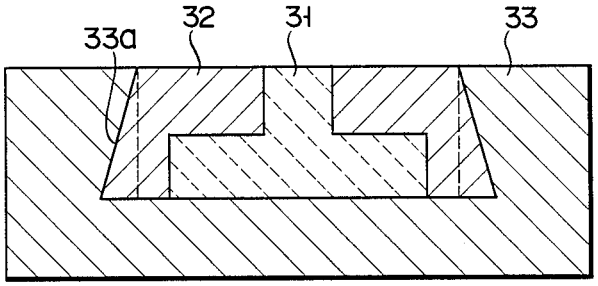

Composite Body in FIG. 9 and Method of Manufacturing the Same

Metal matrix body 33 has a recess having a tapered sectional shape. Ceramic body 31 has a shape obtained by placing a small disk at the center of a large disk. Ceramic body 31 is placed in the recess of matrix body 33 with a predetermined gap left therebetween. Annular presintered metal body 32, indicated by the dotted line, is fitted in the gap. The space enclosed by metal body 32 and matrix body 33 is bonding portion 33*a* of matrix body 33. Metal body 32 is pressed to extend into bonding portion 33*a* and lock therewith. Thereafter, the assembly is sintered to complete the composite body.

Figure 10:
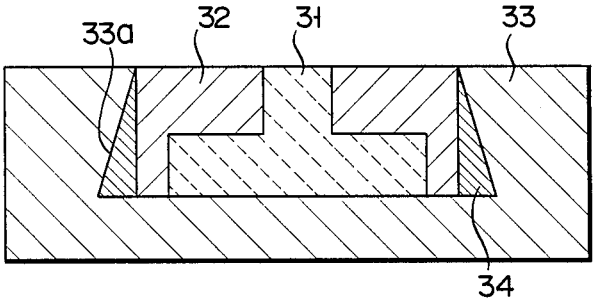

Composite Body in FIG. 10 and Method of Manufacturing the Same

Ceramic body 31 and metal body 32 of the same shapes as those in FIG. 9 are fitted in a recess of matrix body 33. Infiltrator 34 is infiltrated in bonding portion 33*a* of the matrix body through metal body 32 during or after sintering, thereby completing the composite body.

Example

Figure 11:
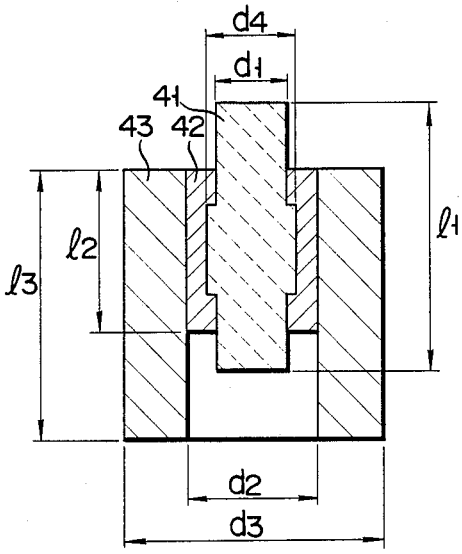
FIG. 11 is a sectional view of a composite body sample according to the present invention.
Figure 12:
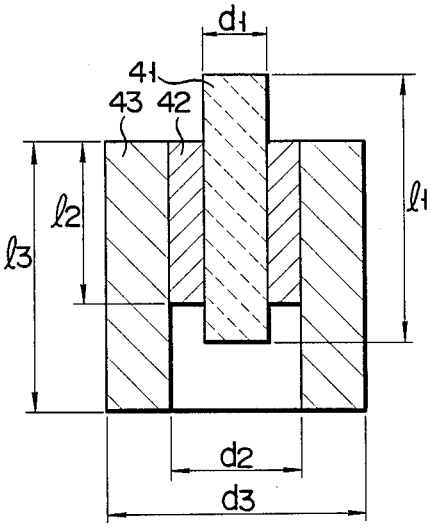
FIG. 12 is a sectional view of a control sample.

Composite body samples having the shape shown in FIG. 11 and control composite body samples having the shape shown in FIG. 12 were prepared. Ceramic bodies 41 of the respective samples were obtained by sintering $Si_3N_4$-5 wt%$Y_2O_3$-4 wt%$Al_2O_3$-3 wt%AlN-1.5 wt%$TiO_2$ at ambient temperature. SUS 304 stainless steel was used as a metal powder for metal bodies 42. SK-3 carbon tool steel was used for matrix bodies 43. The respective samples had the following dimensions: lengths l1=40 mm, l2=18 mm, and l3=30 mm; and diameters d1=10 mm, d2=18 mm, d3=30 mm, and d4=10.5 mm.

Figure 13:
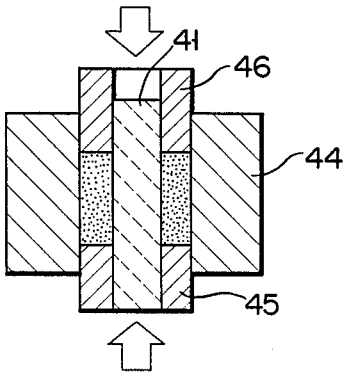
FIG. 13 is a sectional view of a method of manufacturing respective samples.

The respective samples were manufactured in the following manner. As shown in FIG. 13, ceramic body 41 was placed in die 44. After filling the metal powder on lower punch 45 in a space defined by matrix body 43 and ceramic body 41, pressing was performed by upper punch 46 at a pressure of 6 ton/cm$^2$. The assembly was sintered at 1,200° C. to obtain metal body 42, which was contracted by 1.1%. After forming a composite body by combining ceramic body 41 and metal body 42, it was pressed into matrix body 43 by a press machine to obtain the sample shown in FIGS. 11 and 12. In some samples, a copper mass was placed on sintered metal body 42 and heated to allow infiltration.

Figure 14:
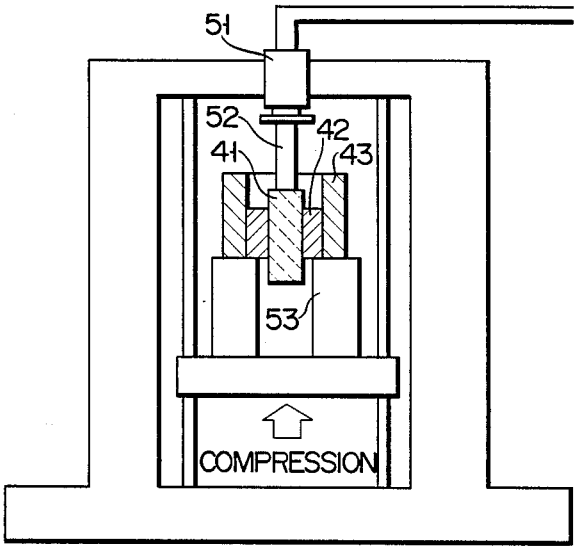
FIG. 14 is a view showing a method of performing a bonding strength test on respective samples.

Each sample prepared in this manner was mounted on a press testing jig, shown in FIG. 14, and was subjected to a press test by a 10 ton universal testing machine, available from Instron Inc., at a crosshead speed of 0.5 mm/min. The obtained results are shown in Table 1. Note that in FIG. 14 reference numeral 51 denotes a load cell; 52, a press rod; and 53, a support ring.

TABLE 1

| Bonding Strength Test Results | | |
|---|---|---|
| Treatment | Composite Body | Bonding Strength (kg/mm$^2$) |
| No infiltration | Control sample | 7.6 |
| | | 7.1 |
| | | 6.8 |
| | | 6.9 |
| | | 7.0 |
| | | 6.9 |
| | Example sample | 8.3 |
| | | 8.3 |
| | | 8.2 |
| | | 8.1 |
| | | 7.8 |
| | | 7.9 |
| Infiltration | Control sample | 11.3 |
| | | 12.3 |
| | Example sample | 14.8 |
| | | 12.8 |
| | | 12.6 |

*Bonding strength = (Load)/(Contact area between ceamic body and sintered metal body)

It is seen from the above Table that when bonding portions comprising steps were formed, the bonding strength was 7.8 to 8.3 kg/mm$^2$. This bonding strength is about 15% higher than Control samples. In the samples of the Example in which copper was infiltrated, the bonding strength was 12.6 to 14.8 kg/mm$^2$. This bonding strength is about 65% higher than the samples in which copper was not infiltrated.

What is claimed is:

1. A composite body, comprising:

a sintered ceramic body having a predetermined shape and having a bonding portion formed on its outer circumferential surface;

a sintered metal body obtained from a powder containing a metal powder as a main component and disposed to cover the outer surface of the ceramic body, said metal body being physically bonded with said ceramic body after fitting with said bonding portion thereof;

a matrix body combined with an outer circumferential surface of said metal body, the thermal expansion coefficient of the matrix body being larger than that of the ceramic body and smaller than that of the metal body; and an infiltrator disposed in the bonding portion.

2. A composite body comprising:

a sintered ceramic body having a predetermined shape and having a bonding portion formed on the inner circumferential surface;

a sintered metal body obtained from a powder containing a metal powder as a main component and disposed inside the ceramic body, said metal body being physically bonded with said ceramic body after fitting with said bonding portion thereof;

a matrix body combined with an outer circumferential surface of said metal body, the thermal expansion coefficient of the matrix body being larger than that of the metal body and smaller than that of the ceramic body; and an infiltrator disposed in the bonding portion.

3. A composite body, comprising:

a sintered ceramic body having a predetermined shape and having a bonding portion formed on the outer circumferential surface;

a sintered metal body obtained from a powder containing a metal powder as a main component, said metal body being disposed to cover the outer circumferential surface of the ceramic body with a space provided between the metal body and the bonding portion of the ceramic body;

an infiltrator filled in said space and bonded with said ceramic body; and a matrix body combined with an outer circumferential surface of said metal body, the thermal expansion coefficient of the matrix body being larger than that of the ceramic body and smaller than that of the metal body.

4. A composite body, comprising:

a sintered ceramic body having a predetermined shape and having a bonding portion formed on the inner circumferential surface;

a sintered metal body obtained from a powder containing a metal powder as a main component, said metal body being disposed inside the inner circumferential surface of the ceramic body with a space provided between the metal body and the bonding portion of the ceramic body;

an infiltrator filled in said space and bonded with said ceramic body; and a matrix body combined with an outer circumferential surface of said metal body, the thermal expansion coefficient of the matrix body being larger than that of the metal body and smaller than that of the ceramic body.

5. A composite body according to claim 1 wherein said bonding portion is an annular groove.

6. A composite body according to claim 2, wherein said bonding portion is an annular groove.

7. A composite body according to claim 3, wherein said bonding portion is an annular groove.

8. A composite body according to claim 4 wherein said bonding portion is an annular groove.

9. A composite body according to claim 1, wherein the bonding portion has a step-like cross-sectional profile.

10. A composite body according to claim 2, wherein the bonding portion has a step-like cross-sectional profile.

11. A composite body according to claim 3, wherein said bonding portion has a step-like cross-sectional profile.

12. A composite body according to claim 4 wherein said bonding portion has a step-like cross-sectional profile.

13. A composite body according to claim 1, wherein said bonding portion of said matrix body has a tapered surface.

14. A composite body according to claim 2, wherein said banding portion of said matrix body has a tapered surface.

15. A composite body according to claim 3, wherein said bonding portion of said matrix body has a tapered surface.

16. A composite body according to claim 4, wherein said bonding portion of said matrix body has a tapered surface.

17. A composite body combining a ceramic and a metal, comprising:

a sintered ceramic body having a predetermined shape and having a stepped bonding portion;

a sintered metal body having a metal powder as a main component thereof, said metal body having a stepped portion physically bonded with said stepped portion of said ceramic body; and an infiltrator disposed in the bonding portion.

18. A composite body according to claim 17, wherein said stepped bonding portion is an annular groove.

19. A composite body according to claim 17, wherein said stepped bonding portion of said sintered ceramic body is disposed on an outer circumferential surface of said ceramic body, said metal body being attached with the outer circumferential surface of said ceramic body, and a thermal expansion coefficient of said ceramic body being larger than that of said metal body.

20. A composite body according to claim 17, further comprising a matrix body attached with an outer circumferential surface of said metal body, the thermal expansion coefficient of said metal body being larger than that of said matrix body, and the thermal expansion coefficient of said matrix body being larger than that of said ceramic body.

21. A composite body according to claim 20, wherein said matrix body has a stepped bonding portion in an inner circumferential surface thereof which is in contact with said metal body.

22. A composite body according to claim 21, wherein said bonding portion of said matrix body has a tapered surface.

23. A composite body according to claim 17, wherein said bonding portion is disposed in an inner circumferential surface of said ceramic body, said metal body being attached with the inner circumferential surface of said ceramic body, said metal body having a thermal expansion coefficient that is larger than that of said ceramic body.

24. A composite body according to claim 17, further comprising a matrix body is combined with an outer circumferential surface of said ceramic body, a thermal expansion coefficient of said ceramic body being larger than that of said matrix body, and the thermal expansion coefficient of said matrix body being larger than that of said metal body.

25. A composite body combining a ceramic and a metal, comprising:

a sintered ceramic body having a predetermined shape and having a stepped bonding portion;

a sintered metal body obtained from a powder, containing a metal powder as a main component, said metal body being combined with said ceramic body so as to form a space between said metal body and said bonding portion of said ceramic body; and an infiltrator filled in said space and bonded with said ceramic body.

26. A composite body according to claim 25, wherein said stepped bonding portion is an annular groove.

27. A composite body according to claim 25, wherein said stepped bonding portion is disposed on an outer circumferential surface of said ceramic body, said metal body being attached with the outer circumferential surface of said ceramic body having said bonding portion, said ceramic body having a thermal expansion coefficient that is larger than that of said metal body.

28. A composite body according to claim 25, further comprising a matrix body attached with an outer circumferential surface of said metal body, the thermal expansion coefficient of said metal body being larger than that of said matrix body, and the thermal coefficient of said matrix body being larger than that of said ceramic body.

29. A composite body according to claim 28, wherein said matrix body has a stepped bonding portion in a surface thereof which is in contact with said metal body.

30. A composite body according to claim 29, wherein said bonding portion of said matrix body has a tapered surface.

31. A composite body according to claim 25, wherein said stepped bonding portion is disposed on an inner circumferential surface of said ceramic body, said metal body is attached with the inner circumferential surface of said ceramic body which has said bonding portion, and a thermal expansion coefficient of said metal body is larger than that of said ceramic body.

32. A method of manufacturing a composite body combining a ceramic and a metal, comprising the steps of:

preparing a sintered ceramic body of a predetermined shape and having a stepped bonding portion;

combining a metal body having a metal powder as a main component thereof with said ceramic body;

pressing said ceramic body and said metal body to allow part of said metal body to deform and fill said stepped bonding portion of said ceramic body;

sintering said metal body and said ceramic body after partial deformation of said metal body so as to lock said ceramic body with said metal body at said stepped bonding portion; and introducing an infiltrator into the stepped bonding portion.

33. A method accoring to claim 32, wherein in said combining step, said metal body is selected from a group consisting of: a powder, a green compact, a presintered body and a sintered body.

34. A method according to claim 32, wherein said sintering step and said infiltration step are simultaneously performed.

35. A method according to claim 32, wherein said infiltration step is performed after said sintering step.

36. The method of manufacturing a composite body according to claim 32, wherein the thermal expansion coefficient of the metal body is controlled by mixing a predetermined amount of a ceramic powder with the metal powder.

37. The method of manufacturing a composite body according to claim 32, wherein the thermal expansion coefficient of the metal body is controlled by mixing a predetermined amount of a ceramic powder with the metal powder.

38. A method of manufacturing a composite body combining a ceramic and a metal, comprising the steps of:

preparing a sintered ceramic body in a predetermined shape and having a stepped bonding portion;

combining said ceramic body with a metal body obtained from a powder containing a metal powder as a main component;

sintering said metal body and said ceramic body which have been combined together; and introducing an infiltrator into the stepped bonding portion, thereby bonding said metal body and said ceramic body at the stepped bonding portion with the infiltrator.

39. A method according to claim 38, wherein said sintering step and said infiltration step are performed simultaneously.

40. A method according to claim 38, wherein in said step of combining said metal body with said ceramic body, said metal body is formed into the predetermined shape by one method selected from the group of processes consisting of pressing, presintering, and sintering.

41. The method of manufacturing a composite body according to claim 38, wherein the thermal expansion coefficient of the metal body is controlled by mixing a predetermined amount of a ceramic powder with the metal powder.

42. The method of manufacturing a composite body according to claim 34, wherein the thermal expansion coefficient of the metal body is controlled by mixing a predetermined amount of a ceramic powder with the metal powder.

43. A method of manufacturing a composite body combining a ceramic and a metal, comprising the steps of:

preparing a sintered ceramic body of a predetermined shape and having a stepped bonding portion;

combining said ceramic body with a metal body having a metal powder as a main component thereof and after being pressed into a shape to fit with said stepped bonding portion;

sintering said ceramic body and said metal body which have been combined together; and introducing an infiltrator into said metal body.

44. A method according to claim 43, wherein said sintering step and said infiltration step are simultaneously performed.

45. A method according to claim 43, wherein said infiltration step is performed after said sintering step.

46. A method according to claim 43, wherein said step of combining said metal body with said ceramic body, said metal body is pressed into the predetermined shape by one method selected from the group of processes consisting of pressing, presintering and sintering.

* * * * *